US009126709B2

(12) United States Patent
Giuliani et al.

(10) Patent No.: US 9,126,709 B2
(45) Date of Patent: Sep. 8, 2015

(54) LABELLING MACHINE

(75) Inventors: Mattia Giuliani, Parma (IT); Marco Ferri, Parma (IT)

(73) Assignee: SIDEL S.p.A. con Socio Unico (IT)

( * ) Notice: Subject to any disclaimer, the term of this patent is extended or adjusted under 35 U.S.C. 154(b) by 184 days.

(21) Appl. No.: 13/703,295

(22) PCT Filed: Jun. 11, 2010

(86) PCT No.: PCT/IT2010/000262
§ 371 (c)(1),
(2), (4) Date: Feb. 18, 2013

(87) PCT Pub. No.: WO2011/154980
PCT Pub. Date: Dec. 15, 2011

(65) Prior Publication Data

US 2013/0139969 A1 Jun. 6, 2013

(51) Int. Cl.
*B65C 9/40* (2006.01)
*B65C 9/00* (2006.01)

(52) U.S. Cl.
CPC ... *B65C 9/40* (2013.01); *B65C 9/00* (2013.01); *B65C 9/0062* (2013.01)

(58) Field of Classification Search
CPC ..... B65C 9/40; B65C 9/42; B65C 9/00; B65C 9/0062; B32B 41/00; B32B 41/02
USPC ..... 156/352, 358, 365, 367
See application file for complete search history.

(56) References Cited

U.S. PATENT DOCUMENTS 6,922,944 B1 8/2005 Krueger
8,052,814 B2 11/2011 Kellhammer et al.

(Continued)

FOREIGN PATENT DOCUMENTS

DE 202004004400 U1 7/2004
DE 102005041531 A1 3/2007
WO WO 2007025592 A1 * 3/2007

OTHER PUBLICATIONS

"International Application Serial No. PCT/IT2010/000262, International Search Report mailed Mar. 14, 2011", 3 pg.

(Continued)

*Primary Examiner* — George Koch
(74) *Attorney, Agent, or Firm* — Schwegman Lundberg & Woessner, P.A.

(57) ABSTRACT

There is described a labelling machine for applying labels onto articles, comprising a protective wall; one first labelling group which may move between an operative position in which it applies a plurality of labels onto corresponding articles, and a rest position; wall comprises at least one first opening which is at least partially engaged, in use, by first labelling group when it is set in operative position; first labelling group is arranged completely on a first side of wall as it is arranged in rest position, and is arranged at least partially on a second side, opposite to first side, of wall when it is arranged in operative position; wall comprises at least one first panel which may be moved between a closed position in which it covers opening, and an open position in which it leaves free opening; labelling machine comprises connecting means for connecting first panel to first labelling group at least when first labelling group moves, in use, between rest position and an intermediate position, which is arranged between operative and rest positions; the movement of first labelling group between intermediate position and rest position causing, in use, the movement of first panel between open and closed position.

9 Claims, 8 Drawing Sheets

(56) References Cited

U.S. PATENT DOCUMENTS

| | | | | |
|---|---|---|---|---|
| 2004/0099379 | A1* | 5/2004 | Erich | 156/567 |
| 2008/0156442 | A1* | 7/2008 | Meinzinger | 156/351 |
| 2009/0294070 | A1* | 12/2009 | Kellhammer et al. | 156/365 |

OTHER PUBLICATIONS

"International Application Serial No. PCT/IT2010/000262, Written Opinion mailed Mar. 14, 2011", 6 pgs.

* cited by examiner

LABELLING MACHINE

RELATED APPLICATIONS

This application is a nationalization under 35 U.S.C. 371 of PCT/IT2010/000262, filed Jun. 11, 2010 and published as WO 2011/154980 A1 on Dec. 15, 2011; which application and publication are incorporated herein by reference in their entirety.

TECHNICAL FIELD

The present invention relates to a labelling machine.

BACKGROUND ART

Labelling machines are known which substantially comprise a carousel for conveying articles to be labelled, i.e. container filled with a pourable food product, and a pair of labelling groups for applying labels to relative containers advanced by conveyor.

More precisely, each labelling group is provided with a respective web of labels wound to form a reel.

Each labelling group substantially supports the reel rotatably about an axis, winds off the reel along a path, separates a label from the web and applies such a label onto the respective container.

Labelling groups apply, one in alternative with one another, respective plurality of labels onto articles 11 conveyed by carousel.

Labelling groups are furthermore movable between respective operative positions in which they apply labels onto corresponding articles, and respective rest positions.

When labelling machine comprises two labelling groups, a first labelling group is arranged in the relative operative position and applies respective labels onto articles while a second labelling group is idle. Once the reel of the first labelling group has been completely wound off, the first labelling group is arranged in the relative rest position and a second group labelling group is arranged in the operative position.

As second labelling group applies labels onto corresponding articles, a new reel of labels is mounted onto first labelling group.

Finally, once the reel of the second labelling group has been completely wound off, the second labelling group is arranged in the relative rest position and the first labelling group with new reel mounted thereon is arranged in the relative operative position.

In this way, the time losses due to the change of the reel are dramatically reduced and the rate of the labelling machine is, therefore, highly enhanced.

Labelling machine also comprises a vertical cylindrical protective wall which surrounds the conveyor, so as to avoid that operators may be injured by the operation of carousel and labelling group.

In particular, labelling groups are partially arranged within the protective wall when they are arranged in respective operative positions, so as to apply labels onto articles conveyed by conveyor.

Differently, labelling groups are arranged outside the protective wall, when they are arranged in respective rest positions, so that an operator may easily mount a new reel onto such labelling groups.

In order to allow labelling groups to be moved from respective operative to respective rest positions, the protective wall comprises two openings through which labelling groups pass.

When they are required to apply labels at a low rate, labelling machines may comprise only one labelling group, which is movable between respective rest and operative positions.

In the latter case, the protective wall comprises only one opening through which the only one labelling group may pass.

Regardless of the number of labelling groups, there is the risk, when each labelling group is in the relative rest position, that the operator may accidently insert a part of his body, i.e. a hand, through the opening and, therefore, that he/she may be injured by the operation of the labelling machine.

To reduce such a risk, labelling machines are known which comprise two panels each movable between a relative closed position in which it covers a respective opening and a relative open position in which it leaves the respective opening free.

Furthermore, a pair of sensor detects the position of the labelling groups, and a plurality of actuators controlled by respective sensors move respective panels between respective closed and open positions.

Clearly, in case that it comprises only one labelling group, the labelling machine comprises only one panel movable between a closed position in which it covers the only one opening and an open position in which it leaves free the only one opening. In a completely analogous manner, this kind of labelling machine comprises only one sensor for detecting the position of the only one panel.

Regardless of the number of labelling group, a failure in the sensor(s) and/or the actuator(s) causes the panel/one of the panels to remain open when respective labelling group is in the rest position, so generating the risk that the operator could unintentionally insert a hand in the opening and be injured by the moving parts of the labelling machine.

Furthermore, in case he/she unintentionally inserts a hand in the opening when the panel(s) moves/move between respective open to respective closed position(s), the operator is likely to be injured by the moving parts of the labelling machine.

Finally, actuators are costly, so resulting in an increased overall cost of the labelling machine.

DISCLOSURE OF INVENTION

It is an object of the present invention to provide a labelling machine, which solves at least one afore-mentioned drawback connected with the known packages in a straightforward, low-cost manner.

According to the present invention, there is provided a labelling machine as claimed in claim 1.

BRIEF DESCRIPTION OF THE DRAWINGS

In the following a preferred, non-limiting embodiment of the present invention will be described by way of example with reference to the accompanying drawings, in which.

BEST MODE FOR CARRYING OUT THE INVENTION

Figure 1:
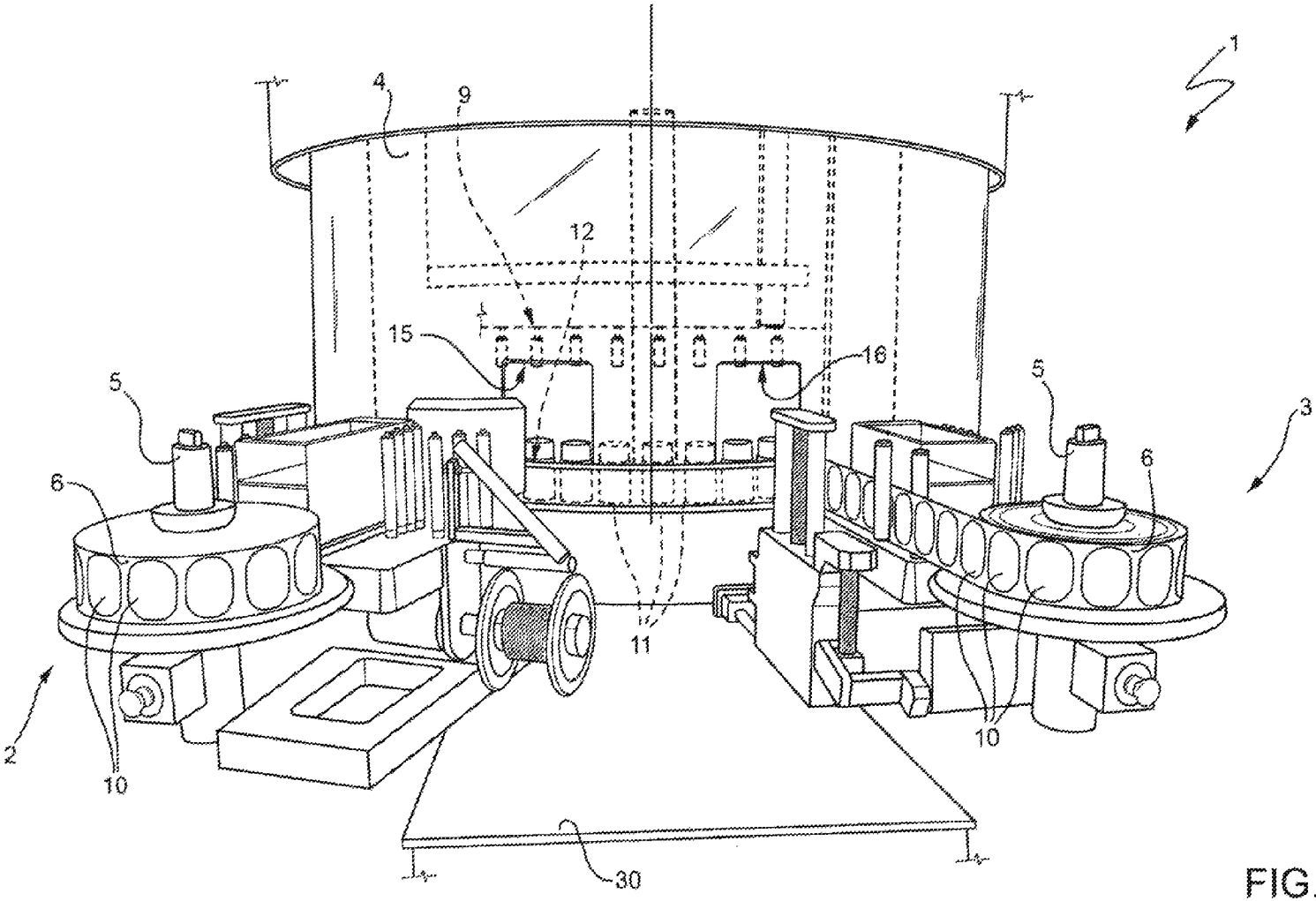
FIG. 1 is a frontal view of the labelling machine according to the present invention.

Number 1 in FIG. 1 indicates as a whole a labelling machine for applying labels 10 to respective articles, containers for pourable food product in the embodiment shown.

More precisely, labelling machine 1 substantially comprises:

- a rotary carousel 9 for advancing articles 11 along an arc-shaped path comprising at least a pair of affixing station 12;
- a pair of labelling groups 2, 3 movable each between a rest position, and an operative position in which it applies a plurality of labels 10 onto articles conveyed by carousel 9 at respective affixing stations 12; and
- a protective wall 4 which surrounds rotary carousel 9 and is adapted to avoid that operators could be injured by the operation of carousel 9 and labelling groups 2, 3 when arranged in respective operative positions.

Each labelling groups 2, 3 substantially comprises (FIGS. 2 to 5):

- a shaft 5 for rotatably supporting a reel 6 off which a backing web bearing labels 10 is unwound and fed along a feed path towards affixing station 12;
- a plurality of unwinding rollers 7 for unwinding backing web along feed path;
- driving means comprising a pair of driving rollers 13 about which backing web is wound and driven by a motor, in order to control the advancement along feed path of labels 10 borne by backing web in accordance with the advancement of articles 11; and
- a dispensing device 8 comprising a peeling blade 8*a* over which a predetermined length of backing web is pulled.

In particular, unwinding rollers 7 are operated to pull backing web off reel 6, and driving rollers 13 are actuated to bring the next label 10 to be applied at the label stop position adjacent to peeling blade 8*a* in time with the sequential arrive thereat of next article 11 to be labelled.

Labelling groups 2, 3 alternatively apply a plurality labels onto respective articles 11 conveyed by conveyor.

In greater detail, at first labelling group 2 is set in respective operative position and applies labels 10 onto articles 11 at respective affixing station 12 while labelling group 3 is idle and arranged in respective operative position.

Once reel 6 has been completely wound off, labelling group 2 is moved to respective rest position and labelling group 3 begins to apply labels 10 onto relative articles 11 at the affixing station 12.

As labelling group 3 applies labels 10 onto articles 11 at respective affixing station 12, a new reel 6 is mounted onto labelling group 2 which is subsequently arranged in respective operative position.

Once reel 6 has been completely wound off, labelling group 3 is moved to the rest position, and labelling group 2 apply again labels 10 onto articles 11 conveyed by carousel 9 at affixing station 12.

In greater detail, labelling groups 2, 3 are arranged on a first side of wall as they are in the respective positions; carousel 9 is arranged on a second side, opposite to first side, of wall 4.

Wall 4 is substantially cylindrical and vertical, in the embodiment shown, and defines two rectangular openings 15, 16 through which respective labelling groups 2, 3 may pass.

Figure 3:
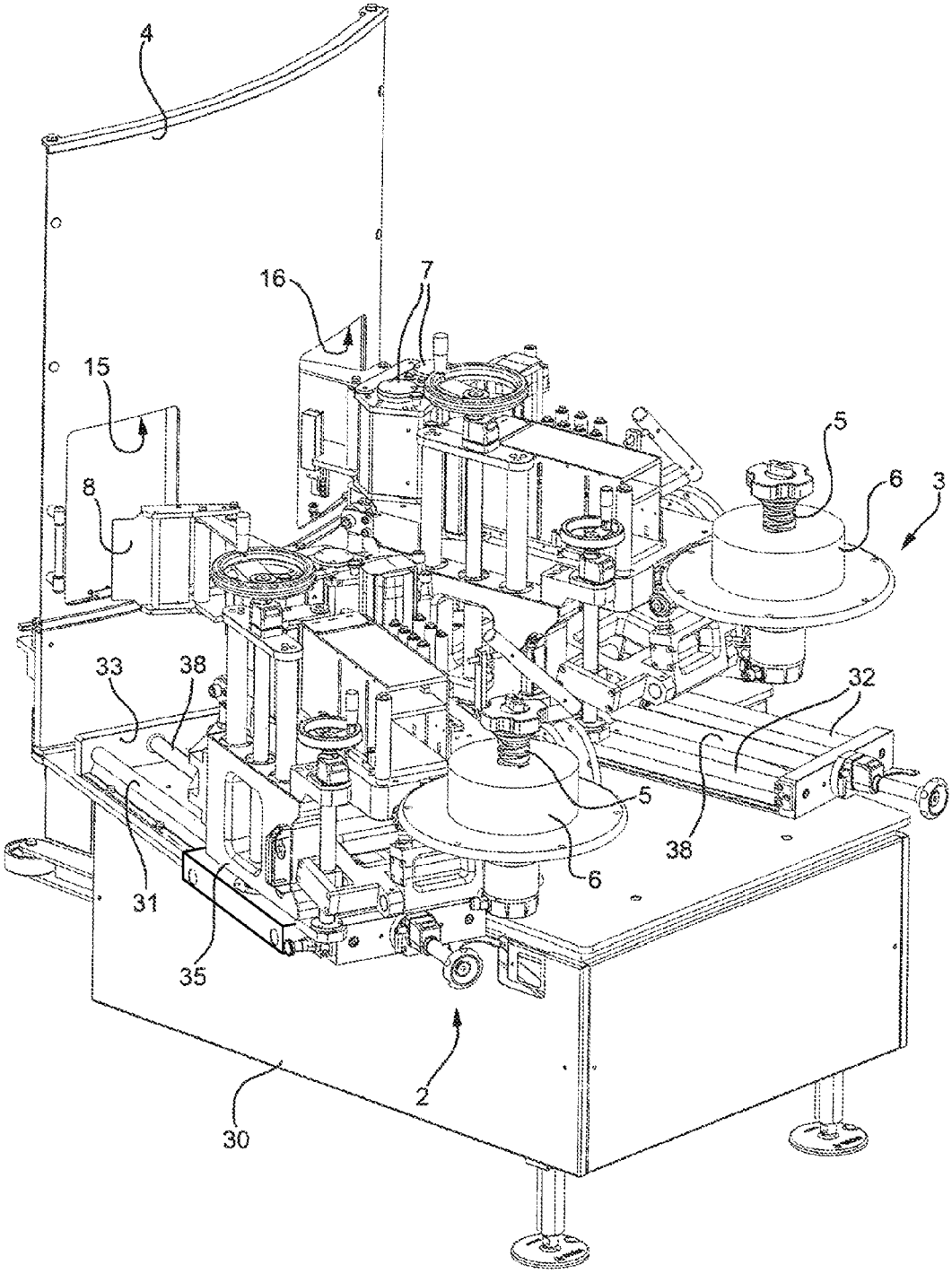

As it is arranged in its rest position, each labelling group 2, 3 is wholly arranged on a first side of wall 4 (see FIG. 3 with reference to labelling group 2).

As it is arranged in its operative position, each labelling group 2, 3 passes through respective opening 15, 16. In other words, a part of labelling group 2, 3 is set on the first side of wall 4, and a part of labelling group 2, 3 is set on a second side, opposite to first side, of wall 4 (see FIG. 2 with reference to labelling group 3)

Labelling machine 1 further comprises two panels 17, 18 rectangular in the embodiment shown. Each panel 17, 18 may be moved between a respective open position (see FIG. 2 with reference to panel 18) in which it leaves free a relative opening 15, 16, and a respective closed position in which it covers relative opening 15, 16 (see FIG. 2 with reference to panel 17).

Advantageously, labelling machine 1 comprises connecting means for connecting panels 17, 18 respectively to labelling groups 2, 3 at least when labelling groups 2, 3 move between respective rest positions and respective intermediate positions; intermediate positions are arranged between respective rest and operative positions; the movement of labelling group 2, 3 between respective intermediate position and respective rest positions causes the movement of panel 17, 18 between respective open position and closed position.

Labelling machine 1 comprises a base 30 which defines two pairs of guides 31, 32 extending substantially radially relative to a rotation axis of the carousel 9.

Guides 31, 32 of each pair extend parallel and are equally spaced to one another.

Figure 2:
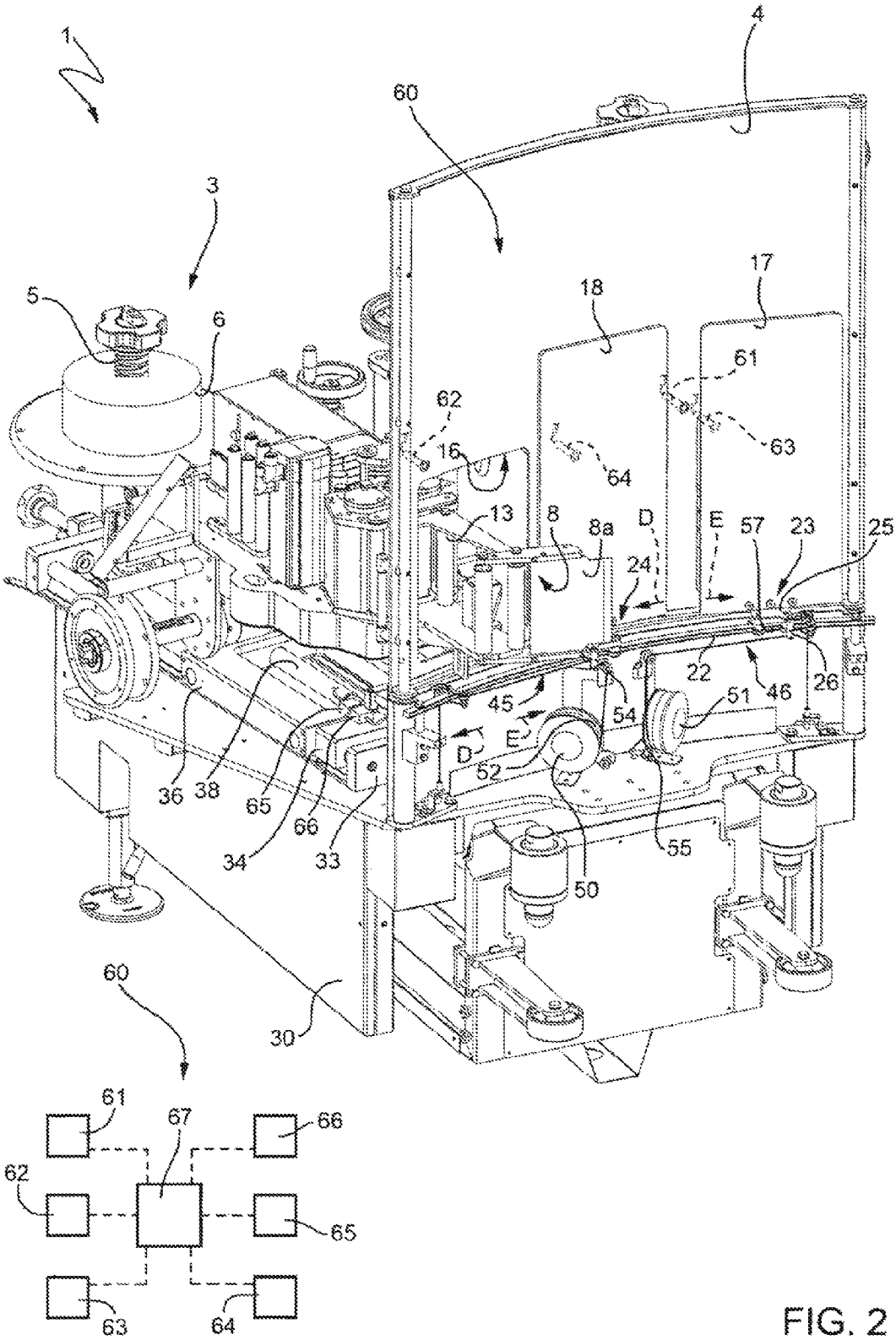
FIGS. 2 to 5 are perspective view along respective visual angle of the labelling machine, with parts removed for clarity in respective different configurations.
Figure 4:
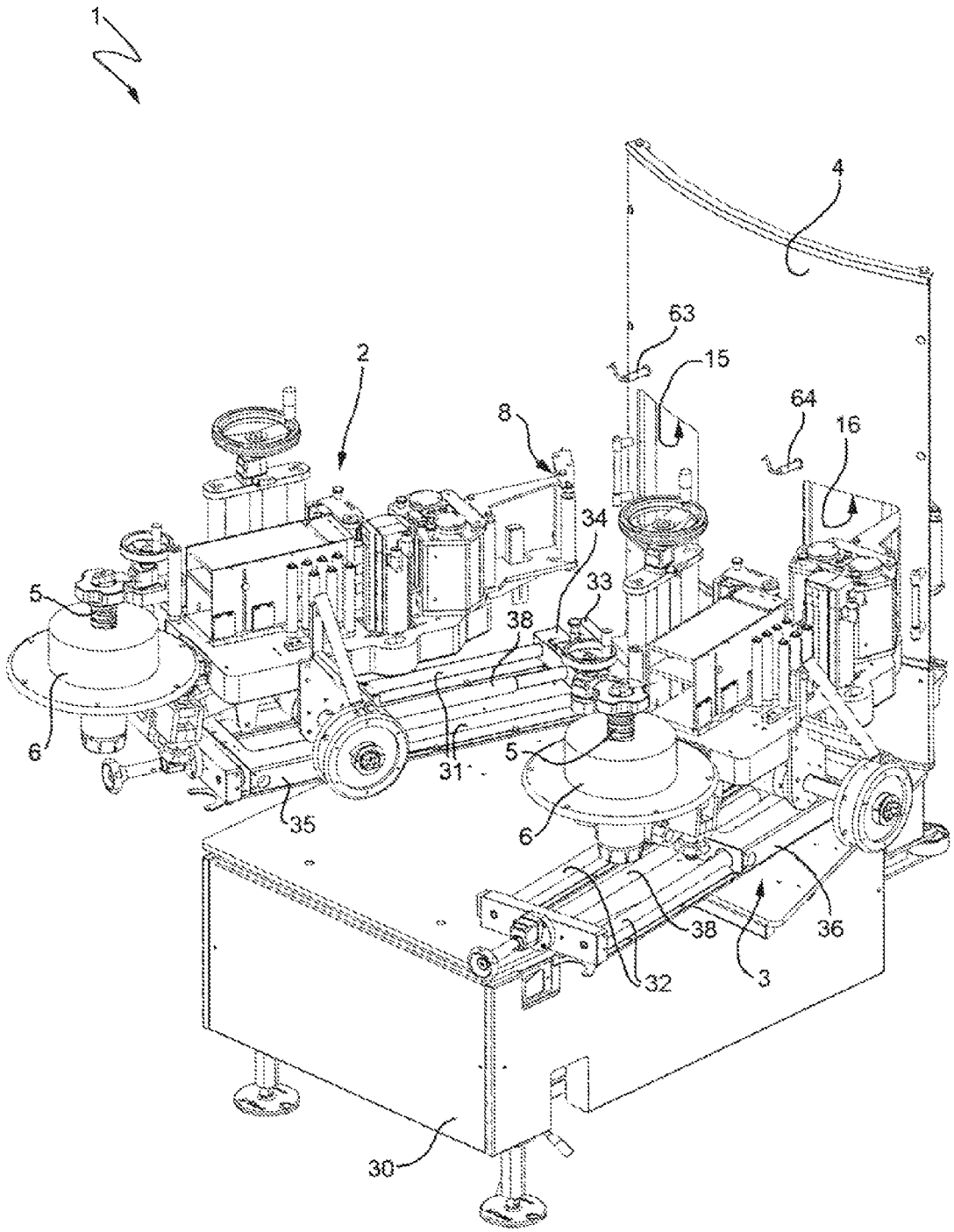

Base 30 also defines a pair of screwed bars 38 (FIGS. 2, 3 and 4).

In particular, a first bar 38 extends parallel and is arranged between guides 31.

In a completely analogous way, a second bar 38 extends parallel and is arranged between guides 32.

Figure 5:
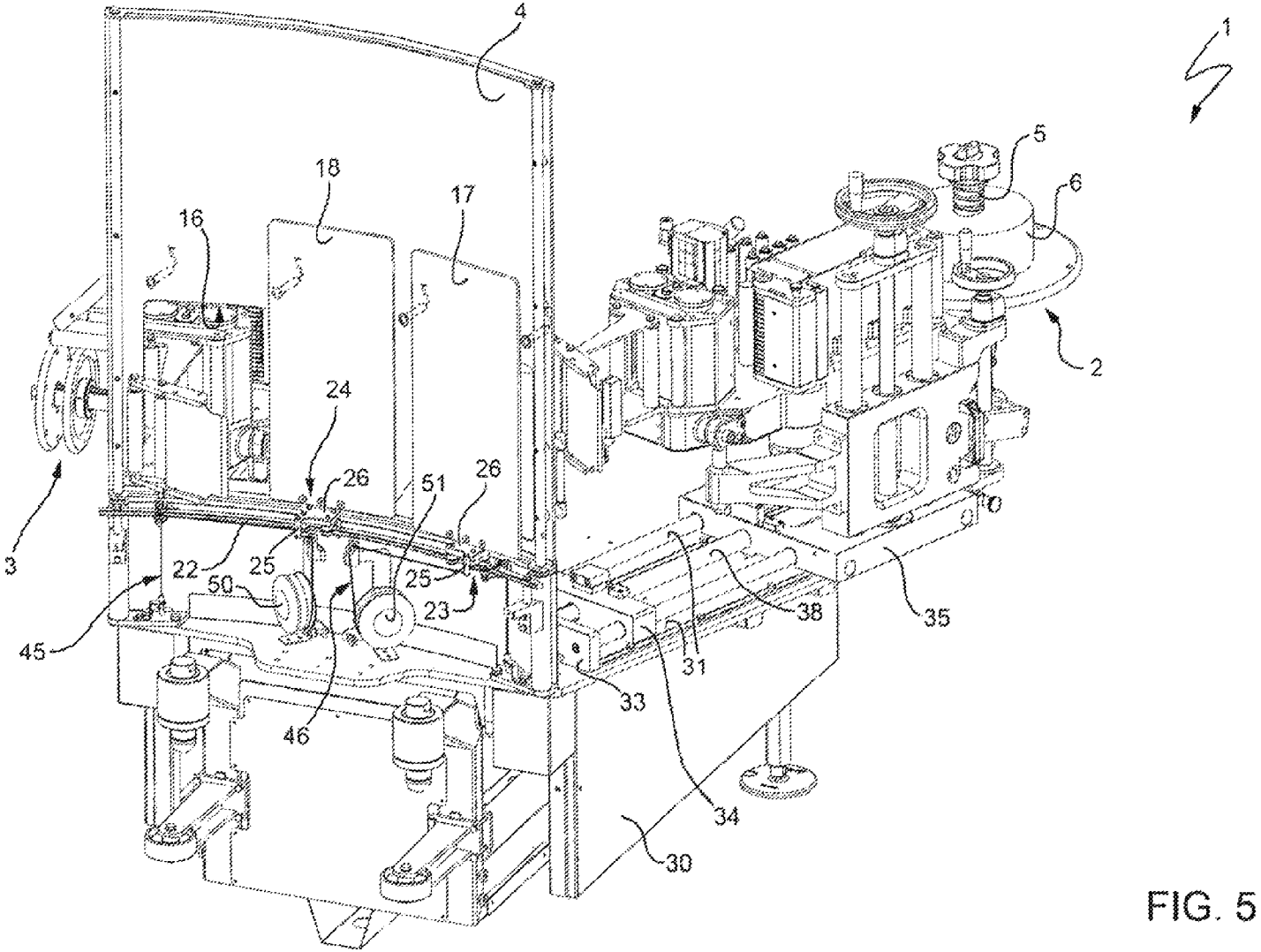
Figure 6:
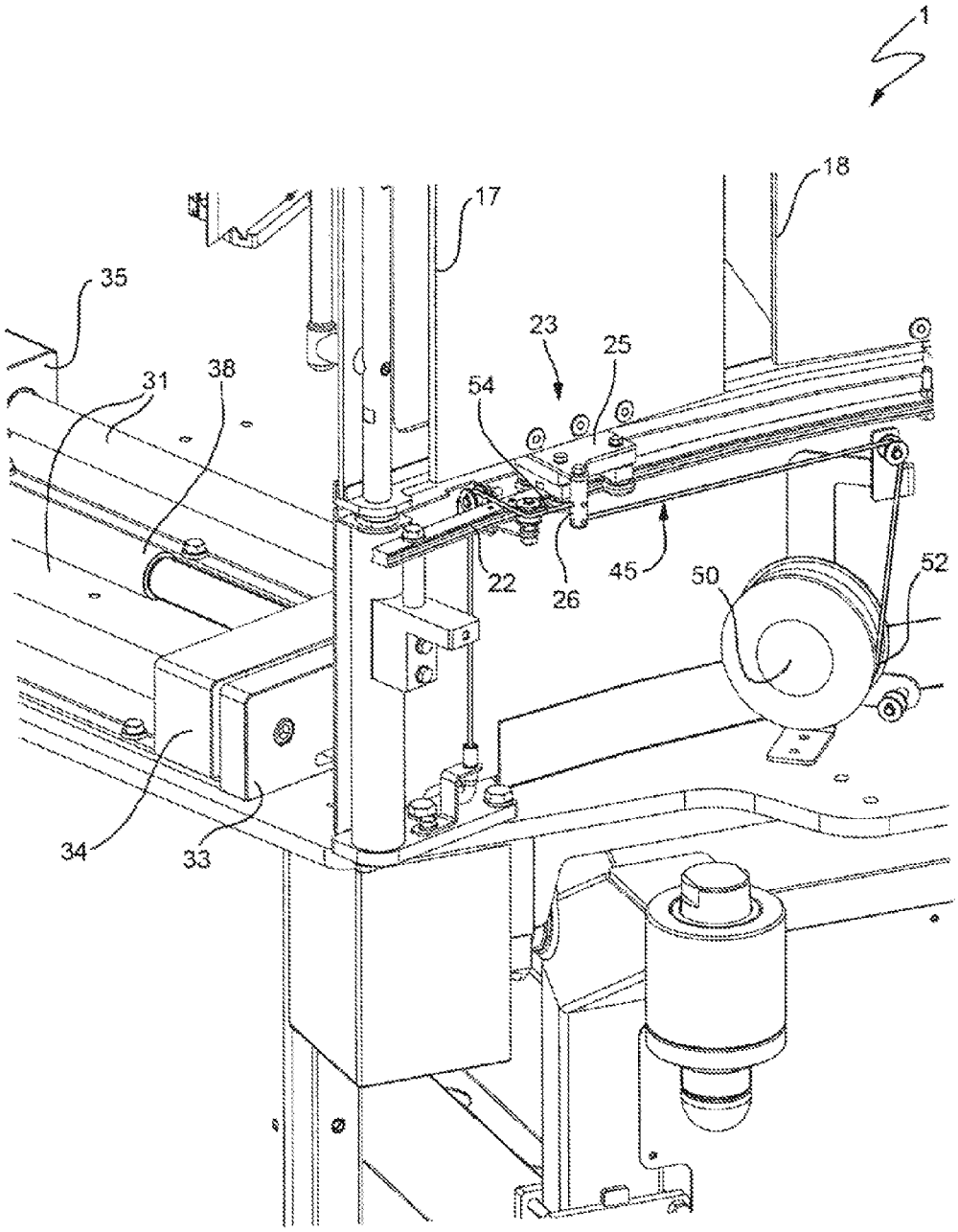
FIGS. 6 and 7 are enlarged perspective view of some particulars of FIGS. 2 to 5.
Figure 7:
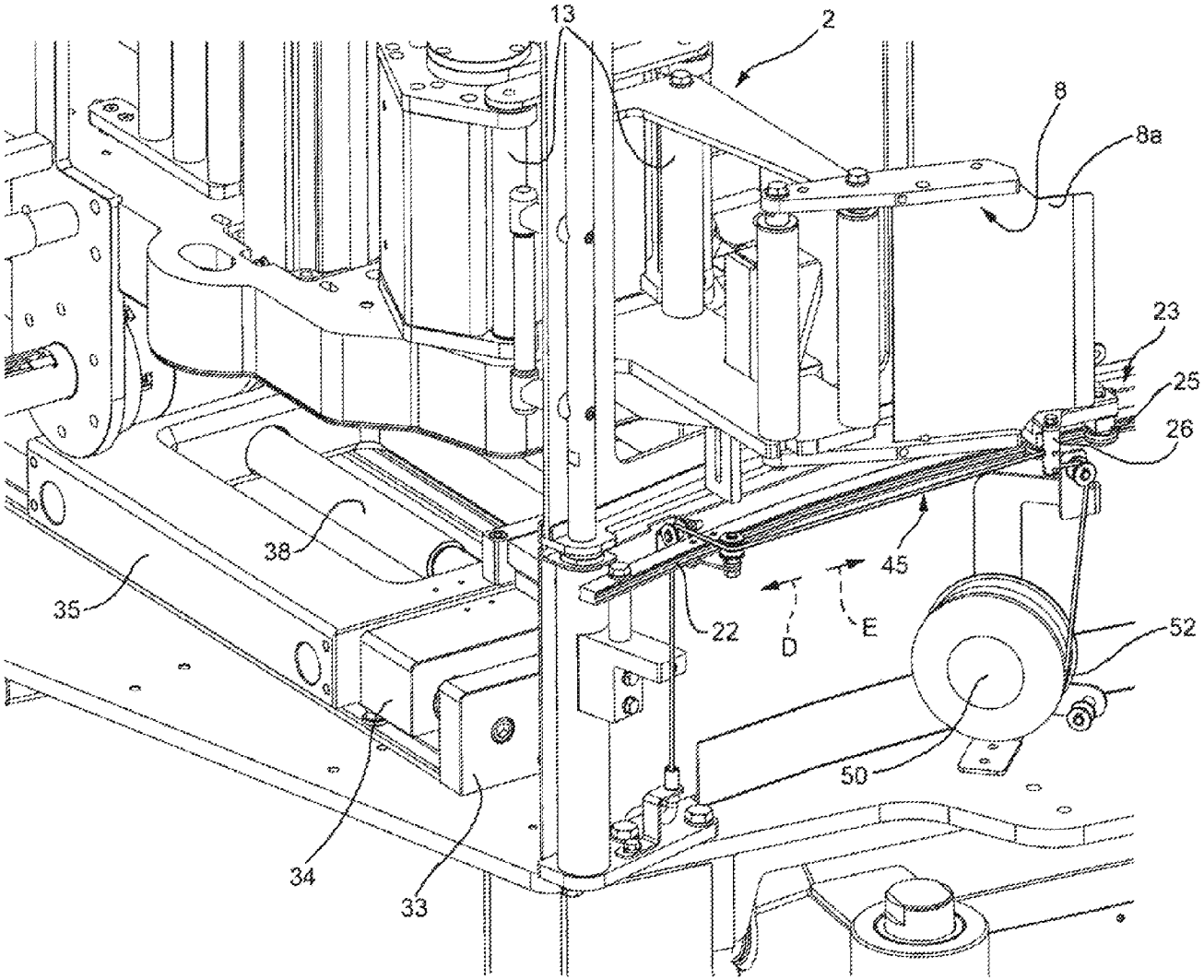

Base 30 further comprises a pair of blocks 34 (FIGS. 4, 5 and 7).

A first block 34 extends orthogonally with respect to guide 31.

More precisely, guides 31 pass through first block 34 with gap while first bar 38 is screwed onto first block 34.

In a completely analogous way, guides 32 pass through second block 34 with gap while second bar 38 is screwed onto second block 34.

Base 30 also comprises a pair of crossbars 33 which are transversal to guides 31, 32, are adjacent to wall 4, and connect to one another end portions of respective guides 31, 32 arranged adjacent to wall 4.

Base 30 extends on the first side of wall 4 and slope one with respect to another.

Each labelling group 2, 3 comprises a relative slide 35, 36 which may slide along respective guides 31, 32.

More precisely, each labelling group 2, 3 may be manually moved away and towards carousel 9, so as to cause relative slide 35, 36 to move along respective guides 31, 32.

Slide 35, 36 contacts relative block 34 as relative labelling groups 2, 3 are in the respective operative positions (see FIG. 7 with reference to labelling group 2).

Differently, slides 35, 36 are spaced apart from block 34 as relative labelling groups 2, 3 are in the respective rest position (see FIG. 3 with reference to labelling group 2).

Labelling machine 1 further comprises:

- an arc-shaped rail 22 adjacent to wall 4 and arranged on the first side of wall 4; and
- a pair of slides 23, 24 connected to respective panel 17, 18 and which may slide onto rail 22.

More precisely, each slide 23, 24 substantially comprises a plate 25 orthogonal and integral to relative panel 17, 18, and a column 26 bolted to plate 25 and extending orthogonally to plate 25.

Each plate 25 is, in the embodiment shown, substantially horizontal as well as each column 26 is, in the embodiment shown, substantially vertical.

Figure 8:
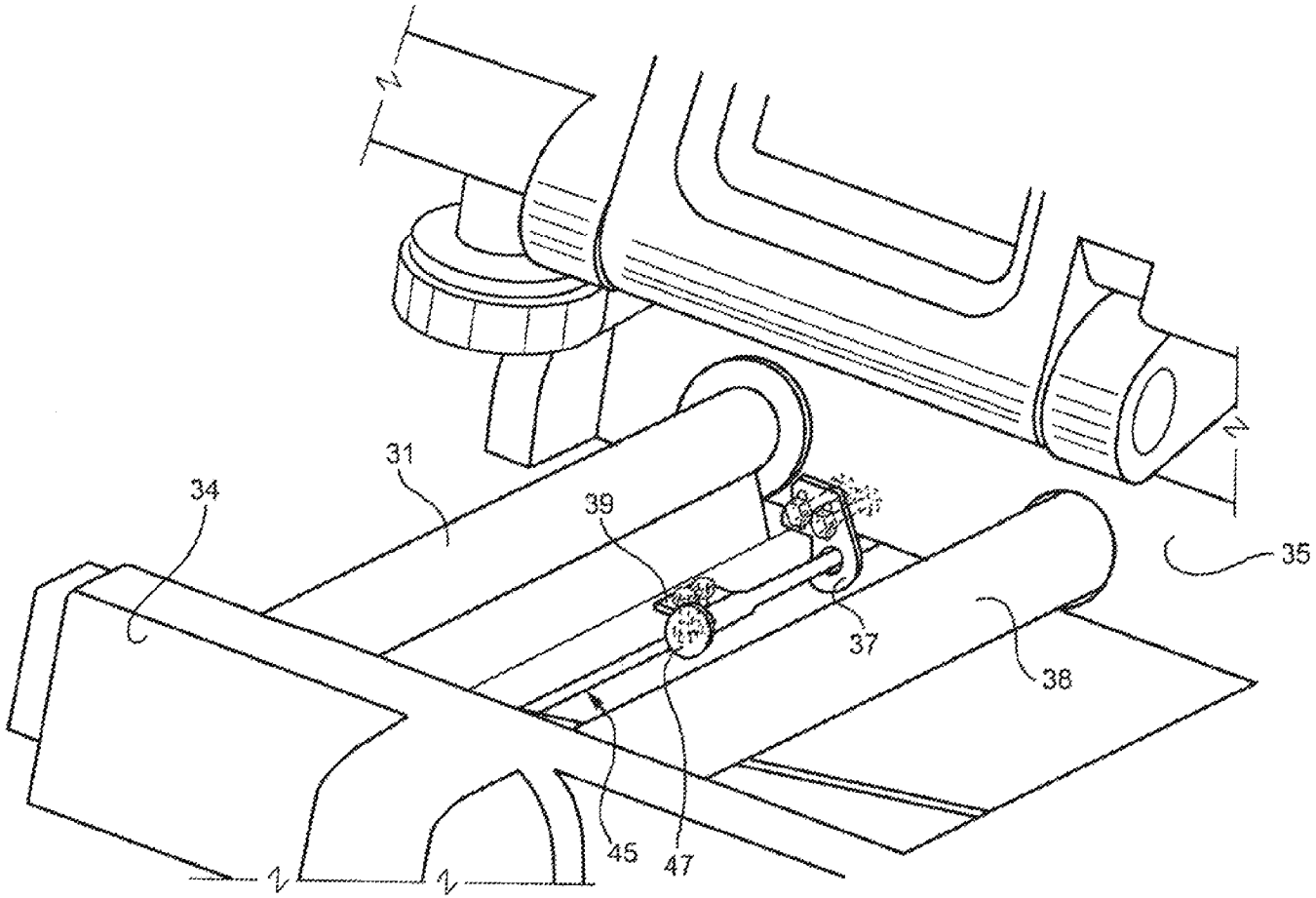
FIG. 8 is a further enlarged view of further particulars of FIGS. 2 to 6.

Labelling groups 2, 3 are provided respectively with relative hooks 37 (FIG. 8).

In particular, slides 35, 36 have relative surfaces which face block 34 and are provided with relative hooks 37.

Connecting means are, in particular, flexible and comprise (FIG. 8):

- a wire 45 integral with panel 17 and bearing a respective end element 47 which is engaged by relative hook 37, as labelling group 2 moves from the respective intermediate to the respective rest position; and
- a wire 46 integral with panel 18 and bearing a respective end element 47 which is engaged by relative hook 37, as labelling group 3 moves from the respective intermediate to the respective rest position.

Base 30 comprises a pair of stop elements 39 which cooperate with relative end elements 47 of wires 45, 46 as labelling groups 2, 3 move between relative rest and intermediate positions (FIG. 8).

The stroke of each labelling groups 2, 3 from relative operative to relative rest position comprises:

- a first portion which extends from relative operative to relative intermediate position, and along which hooks 37 do not engage relative end elements 47; and
- a second portion which extends from relative intermediate to relative rest position, and along which hooks 37 engage relative end elements 47.

In this way, panels 17, 18 are moved from relative open to relative closed positions only after that labelling groups 2, 3 have passed through relative openings 15, 16 and are wholly arranged on the first side of wall 4.

In a completely analogous manner, the stroke of labelling groups 2, 3 from relative rest to relative operative comprises:

- a first portion which extends from relative rest to relative intermediate position, and along which hooks 37 engage relative end elements 47; and
- a second portion which extends from relative intermediate to relative operative position, and along which hooks 37 do not engage relative end elements 47.

In this way, panels 17, 18 move from relative closed to relative open position before that labelling groups 2, 3 have passed through relative openings 15, 16.

Wires 45, 46 are, in the embodiment shown, made of steel.

Furthermore, labelling machine 1 comprises a spring 50 and a spring 51 (FIGS. 2, 5, 6 and 7). Spring 50, 51 are, in the embodiment shown, torsional springs.

Springs 50, 51 keep tense respective wires 45, 46. Wire 45 comprises (FIG. 7):

- an end 52 attached to spring 50;
- a further end, opposite to end 52, which is attached to end element 47; and
- a portion 54 which is intermediate between end and relative end element 47, and is connected to column 26 of slide 23.

Wire 46 comprises:

- an end 55 attached to spring 51;
- a further end, opposite to end 52, which is attached to relative end element 47; and
- a portion 57 which is intermediate between ends 55 and relative end element 47, and is connected to column 26 of slide 24.

Labelling machine 1 also comprise a plurality of idle rollers which project from wall 4 and arrange wires 45, 46 according to a given path.

Labelling machine 1 finally comprises a system 60 for detecting the rupture of wires 45, 46.

System 60 comprises (FIG. 2):

- a sensor 63 arranged onto panel 17;
- a sensor 64 arranged onto panel 18;
- a sensor 61 arranged at the contour of opening 15;
- a sensor 62 arranged at the contour of opening 16.

Furthermore, system 60 comprises:

- a pair of sensors 65 arranged onto relative slides 35, 36;
- pair of sensors 66 arranged onto blocks 34 and in front of respective sensors 65.

Sensors 63, 64 contact respectively sensors 61, 62 when panels 17 and 18 are in the respective closed positions.

Differently, sensors 63, 64 are spaced apart from respective sensor 61, 62 when panels 17 and 18 are in the open position.

Sensors 61, 62, 63, 64 are programmed for detecting when panels 17, 18 are arranged in respective closed positions.

Furthermore, each sensor 65 contacts a respective sensor 66 as relative slide 35, 36 contacts relative block element 34 i.e. when labelling groups 2, 3 are in relative operative position.

Differently, each sensor 65 is spaced apart from a respective sensor 66 as relative slide 35, 36 is spaced apart from crossbar 33, i.e. when labelling groups 2, 3 are in relative rest position.

Sensors 65, 66 are programmed for detecting when labelling groups 2, 3 are arranged in respective rest positions.

System 60 also comprise a control unit 67 (only schematically shown in FIG. 2) for interrupting the operation of labelling machine 1 in case of rupture of wires 45 (46) and/or in case that the operator fails to completely move labelling group 2 (3) to the relative rest position.

More precisely, control unit 67 interrupts the operation of labelling machine 1 when:

- either both sensor 61 (63) is spaced apart from sensor 62 (64) and sensor 66 is spaced apart from relative sensor 65; or
- both sensor 61 (63) contacts sensor 62 (64) and sensor 66 contacts relative sensor 65.

Control unit 67 may be programmed for interrupting the operation of labelling machine 1 only after that a certain amount of time is passed since when labelling groups 2, 3 move from respective operative or rest positions.

Finally, labelling machine 1 comprises, for each wire 45, 46, a first and second pulley about respective which relative wires 45, 46 winds. Each pair of first and second pulley is integrally rotatable about the same axis. The diameter of first pulley is greater than of the diameter of second pulley.

In particular, each first pulley is interposed between a relative slide 23, 24 and the relative second pulley.

As a result, when wires 45, 46 connect panels 17, respectively to labelling group 2, 3, the displacement of slides 23, 24 is greater than the displacement of corresponding slide 35, 36. In particular, the ratio between the diameters of first and second pulley equals the ratio between the displacement of slides 23, 24 and of corresponding slides 35, 36.

In the embodiment shown, the displacement of slides 23, 24 and, therefore, of panels 17, 18 is double than the displacement of corresponding slides 35, 36, and therefore, of relative labelling group 2, 3.

The operation of labelling machine 1 is described starting from a configuration in which labelling group 2 is in the operative position and applies labels 10 onto relative articles 11 at relative affixing station 12 while labelling group 3 is idle and arranged in the operative position.

In this configuration, panels 17, 18 are both in the respective open positions, and labelling groups 2, 3 both pass thorough respective openings 15, 16; furthermore, end elements 47 of wires 45, 46 contact relative stop elements 39 (FIG. 8) and slide 35 contacts relative block element 34.

Once reel 6 of labelling group 2 has been completely wound off, labelling group 2 is moved to respective rest position.

More precisely, the operator moves labelling group 2 on the opposite side of carousel 9, so causing the sliding of slide 35 onto guide 31.

As a consequence, labelling group 2 at first reaches respective intermediate position and then reaches respective relative position.

As labelling group 2 moves between respective operative and intermediate positions, hook 37 does not engage end element 47 of wire 45. As a result, panel 17 remains in the open position, so allowing labelling group 2 to pass through opening 15.

As labelling group 2 moves between respective intermediate and rest position, hook 37 engages end element 47 of wire 45 and moves away end elements 47 from relative stop element 39.

Wire 45 moves therefore in a first direction D, so causing in turn, the sliding of slide 23 and panel 17 along rail 22 in the first direction D.

As a result, the movement of labelling group 2 from relative intermediate to relative rest position results in the movement of panel 17 from relative open to relative closed position.

As labelling group 2 reaches relative rest position, an operator mounts new reel 6 onto relative shaft 5.

Due to the fact that opening 15 is covered by panel 17, there is substantially no risk that operator could be injured, as he/she mounts new reel 6 onto shaft 5.

Once new reel 6 has been mounted onto shaft 5 of labelling group 2, the operator moves labelling group 2 towards carousel 9, so causing the sliding of slide 35 onto guide 31 towards such carousel 9.

As a consequence, labelling group 2 at first reaches respective intermediate position and then reaches respective operative position.

Accordingly, slide 35 moves towards relative block element 34, and, therefore, the whole labelling group 2 moves towards carousel 9 of labelling machine 1.

As labelling group 2 moves between respective rest and intermediate positions, spring 50 keeps tense wire 45. As a result, hooks 37 and element 47 remain engaged with one another. Accordingly, wire 45 moves in a second direction E, opposite to the first direction D, so causing in turn, the sliding of slide 23 and panel 17 along rail 22 in the second direction E.

In this way, the movement of labelling group 2 from relative rest to relative intermediate position results in the movement of panel 17 from relative closed to relative open position.

As labelling group 2 reaches relative intermediate position, end element 47 abuts against and is stopped by relative stop element 39.

Accordingly, as labelling group 2 moves between respective intermediate and operative position, hook 37 does not engage end element 47 of wire 45.

Labelling group 2 therefore passes through opening 15.

Once labelling group 2 reaches operative positions, slide 35 contacts relative block 34.

Once that reel 6 has been mounted onto shaft 5 of labelling group 3 is completely wound off, labelling group 2 is operated to apply labels 10 onto relative articles 11 at the affixing station 12, and labelling group 3 is moved from respective operative position to respective rest position.

As labelling group 3 moves towards relative intermediate position, panel 18 leaves free opening 15. As labelling group 3 moves from relative intermediate to relative rest position, panel 18 covers opening 16. Once that labelling group 3 has reached relative intermediate position, a new reel 6 is mounted onto shaft 5 of labelling group 3.

In case that one of wire 45, 46 breaks and/or the operator fails to completely move one of labelling group 2, 3 to relative rest position, both sensor 61 (63) is spaced apart from sensor 62 (64) and sensor 66 is spaced apart from relative sensor 65. Alternatively, both sensor 61 (63) contact sensor 62 (64) and sensor 66 contacts relative sensor 65. In such a case, control unit 67 interrupts the operation of labelling machine 1.

From an analysis of the features of labelling machine 1 made according to the present invention, the advantages it allows to obtain are apparent.

In particular, the movement of labelling groups 2 (3) from respective operative to respective rest positions causes, through respectively wire 45 (46), the displacement of panels 17 (18) into the relative closed position.

As a result, when labelling groups 2, 3 is in relative rest position, the operator is prevented from being injured by operation of labelling machine 1.

Such a result is achieved without requiring the presence of actuators acting on panels 17, 18.

Accordingly, there is substantially no risk that the malfunction of actuators provided by known labelling machines cause a risk of injury for the operator.

Moreover, when panels 17, 18 move from relative open to relative closed positions, the operator is moving labelling group 2, 3 from relative intermediate to relative rest positions.

Accordingly, the operator is far from openings 15, 16 and thus there is substantially no risk that the operator could be injured by the movement of panels 17, 18 from respective open towards respective closed position.

Control unit 67 interrupts the operation of labelling machine 1 in case that one of wires 45, 46 is broken and/or the operator fails to completely move at least one of labelling groups 2, 3 to the relative rest position.

Therefore, there is no risk that the operation of labelling machine 1 injuries the operator.

Finally, it is apparent that modifications and variants not departing from the scope of protection of the claims may be made to labelling machine 1.

In particular, labelling machine 1 could comprise only one labelling group 2, 3. In this case, wall 4 would comprise only one opening 15, 16, only one panel 17, 18, only one pair of guides 31, 32, only one wire 45, 46, only one spring 50, 51 and only one slide 25, 26.

Wire 45, 46 may be replaced by Bowden cables.

Slide 22 could be replaced by two independent vertical guides along which relative slides 23, 24 is movable.

The invention claimed is:

1. A labelling machine for applying labels onto respective articles, comprising:

a protective wall;

at least one first labelling group which may move between an operative position in which it applies a plurality of labels onto corresponding said articles, and a rest position;

said wall comprising at least one first opening which is at least partially engaged, in use, by said first labelling group when it is arranged in said operative position;

said first labelling group being arranged completely on a first side of said wall as it is arranged in said rest position, and being arranged at least partially on a second side, opposite to said first side, of said wall when it is arranged in said operative position;

said wall further comprising at least one first panel which may be moved between a closed position in which it covers said opening, and an open position in which it leaves free said opening;

connectors for connecting said first panel to said first labelling group at least when said first labelling group moves, in use, between said rest position and an intermediate position, which is arranged between said operative and rest positions, wherein said connectors are flexible, wherein said connectors comprise a first cable which may be connected to said first labelling group and to said first panel;

the movement of said first labelling group between said intermediate position and said rest position causing, in use, the movement of said first panel between said open and said closed position.

2. The labelling machine of claim 1 wherein the first cable comprises a first engaging element, and in that said first labelling group comprises a second engaging element;

said first engaging element engaging, in use, said second engaging element when said first labelling group moves, in use, between said rest and intermediate positions.

3. The labelling machine of claim 2, further comprising at least one first guide, and in that said first labelling group comprises a first slide which may move onto said first guide;

said labelling machine further comprising at least one second guide;

said first panel being integrally connected to a second slide which may slide along said second guide;

said first cable being connectable to said first slide and being connected to said second slide.

4. The labelling machine of claim 3, further comprising a first and second pulley which rotate integrally one with respect to another and about which said first cable winds;

said first and second pulley being interposed between said second slide and said first engaging element;

said first and second pulley having respectively a first and a second diameter which is different from said first diameter, so that the displacement of said second slide is different from the displacement of said first slide, when said first engaging element engages, in use, said second engaging element.

5. The labelling machine of claim 1, further comprising elastic means adapted to keep tense said connectors.

6. The labelling machine of claim 5, wherein said elastic means comprise at least one first spring which is connected to a first end of said first cable and is adapted to load said first cable towards a position, at which said first panel is arranged in said closed position;

said first cable comprising a second end, opposite to said first end, at which said first engaging element is fixed.

7. The labelling machine of claim 1, further comprising a conveyor for conveying said articles to be applied towards an affixing station;

said conveyor being arranged on said second side of said wall.

8. A labelling machine for applying labels onto respective articles, comprising:

a protective wall;

at least one first labelling group which may move between an operative position in which it applies a plurality of labels onto corresponding said articles, and a rest position;

said wall comprising at least one first opening which is at least partially engaged, in use, by said first labelling group when it is arranged in said operative position;

said first labelling group being arranged completely on a first side of said wall as it is arranged in said rest position, and being arranged at least partially on a second side, opposite to said first side, of said wall when it is arranged in said operative position;

said wall further comprising at least one first panel which may be moved between a closed position in which it covers said opening, and an open position in which it leaves free said opening;

connectors for connecting said first panel to said first labelling group at least when said first labelling group moves, in use, between said rest position and an intermediate position, which is arranged between said operative and rest positions;

the movement of said first labelling group between said intermediate position and said rest position causing, in use, the movement of said first panel between said open and said closed position;

first sensor means for detecting, in use, the position of said first labelling groups relative to a fixed part of said labelling machine;

second sensor means for detecting, in use, the position of said first panel relative respectively to said first opening; and a control unit functionally connected to said first and second sensor means and programmable for interrupting the operation of said labelling machine, in case that said first labelling group is in said rest position and said first and panel is set in respective open position.

9. A labelling machine for applying labels onto respective articles, comprising:

a protective wall;

at least one first labelling group which may move between an operative position in which it applies a plurality of labels onto corresponding said articles, and a rest position;

said wall comprising at least one first opening which is at least partially engaged, in use, by said first labelling group when it is arranged in said operative position;

said first labelling group being arranged completely on a first side of said wall as it is arranged in said rest position, and being arranged at least partially on a second side, opposite to said first side, of said wall when it is arranged in said operative position;

said wall further comprising at least one first panel which may be moved between a closed position in which it covers said opening, and an open position in which it leaves free said opening;

connectors for connecting said first panel to said first labelling group at least when said first labelling group moves, in use, between said rest position and an intermediate position, which is arranged between said operative and rest positions;

the movement of said first labelling group between said intermediate position and said rest position causing, in use, the movement of said first panel between said open and said closed position;

a second labelling group which may move between a further operative position, in which it applies, in alternative with said first labelling group, a respective plurality of said labels onto corresponding said article, and a respective further rest position;

said wall comprising a second opening which is at least partially engaged, in use, by said second labelling group when it is set in said further operative position;

said second labelling group being arranged completely on said first side of said wall as it is arranged in said further rest position, and is arranged at least partially on said second side of said wall when it is arranged in said further operative position;

said wall further comprising a second panel which may be moved between a further open position in which it leaves free said second opening, and a closed position in which it covers said second opening;

connectors connecting, in use, said second panel to said second labelling group at least when said second labelling group moves, in use, between said further rest position and a further intermediate position, which is arranged between said further operative and rest positions;

the movement of said second labelling group between said further intermediate position and said further rest position causing, in use, the movement of said second panel between said further open and further closed position.

* * * * *